US009945198B2

(12) United States Patent
Stowe, II et al.

(10) Patent No.: US 9,945,198 B2
(45) Date of Patent: Apr. 17, 2018

(54) CASING EXIT MILLS AND APPARATUS AND METHODS OF USE

(71) Applicants: Calvin J. Stowe, II, Bellaire, TX (US); Tejas J. Ghegadmal, Houston, TX (US)

(72) Inventors: Calvin J. Stowe, II, Bellaire, TX (US); Tejas J. Ghegadmal, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 313 days.

(21) Appl. No.: 14/795,455

(22) Filed: Jul. 9, 2015

(65) Prior Publication Data

US 2016/0010412 A1 Jan. 14, 2016

Related U.S. Application Data

(60) Provisional application No. 62/022,504, filed on Jul. 9, 2014.

(51) Int. Cl.

| | |
|---|---|
| ***E21B 29/00*** | (2006.01) |
| ***E21B 29/06*** | (2006.01) |
| ***E21B 7/06*** | (2006.01) |

(52) U.S. Cl.
CPC ..... *E21B 29/002* (2013.01); *E21B 7/061* (2013.01); *E21B 29/06* (2013.01)

(58) Field of Classification Search
CPC ..... E21B 29/002; E21B 7/061; E21B 29/06; E21B 29/00
See application file for complete search history.

(56) References Cited

U.S. PATENT DOCUMENTS

| | | | | |
|---|---|---|---|---|
| 5,551,509 | A | 9/1996 | Braddick | |
| 5,592,991 | A * | 1/1997 | Lembcke | E21B 7/061 166/117.6 |
| 5,727,629 | A * | 3/1998 | Blizzard, Jr. | E21B 7/061 166/117.6 |
| 6,109,347 | A * | 8/2000 | Ferguson | E21B 7/061 166/117.5 |
| 6,926,100 | B1 | 8/2005 | Anthony et al. | |
| 7,490,663 | B2 * | 2/2009 | Lewis | E21B 17/10 166/55.1 |
| 2009/0133877 | A1 | 5/2009 | Neff | |
| 2009/0139721 | A1 * | 6/2009 | Verma | E21B 29/06 166/298 |

(Continued)

OTHER PUBLICATIONS

PCT International Search Report and Written Opinion; International Application No. PCT/US2015/039661; International Filing Date: Jul. 9, 2015; dated Sep. 23, 2015; pp. 1-11.

*Primary Examiner* — Michael R Wills, III
(74) *Attorney, Agent, or Firm* — Cantor Colburn LLP

(57) ABSTRACT

A mill for use in milling a section in a wellbore is disclosed that includes a first concave curved section followed by a substantially flat section and a second concave curved section following the substantially flat section and a number of blades attached to the first concave curved section, substantially flat section and the second concave curved section, wherein each such blade includes a first convex curved portion that corresponds to the first concave curved section and a second convex curved portion that corresponds to the second concave curved section.

19 Claims, 4 Drawing Sheets

(56) References Cited

U.S. PATENT DOCUMENTS

| | | | | |
|---|---|---|---|---|
| 2011/0174477 | A1 | 7/2011 | Verma et al. | |
| 2013/0199784 | A1 | 8/2013 | Swadi et al. | |
| 2015/0152702 | A1* | 6/2015 | Stowe | E21B 10/46 166/55.7 |

* cited by examiner

CASING EXIT MILLS AND APPARATUS AND METHODS OF USE

CROSS-REFERENCES TO RELATED APPLICATION

This application takes priority from U.S. Provisional application Ser. No. 62/022,504, filed on Jul. 9, 2014, which is incorporated herein in its entirety by reference.

BACKGROUND

1. Field of the Disclosure

The present disclosure is related to a milling apparatus for milling casing exits and to perform other cutting operations in wellbores.

2. Background of the Art

Conventional cylindrical mills are commonly utilized for milling windows (or sections) in metal casings (such as pipes) placed in wellbores to provide exits for forming lateral wellbores and to perform other downhole cutting operations. Often, three mills (a window mill, a lower mill and an upper mill) are used on a bottomhole assembly (BHA) to perform the milling operations. Such mills generally include an enlarged pipe section (larger diameter section) that transitions to a smaller diameter pipe on both sides at a taper angle, typically 15°, with a small blending radius at both ends of the taper. Blades are welded over the tapered sections and the enlarged section. Although such tapers or tapered sections along with the small blending radiuses appear to provide a smooth transition between the two diameters to avoid stress concentration, the analysis and operational experience show a relatively high concentration of stress at such transitions. Additionally, the lower mill is the most highly stressed member of the bottomhole assembly (BHA). During milling operations, as the window mill moves down the ramp and laterally through the casing wall, the lower mill body is bent. High stress concentration occurs at the end of the blades, causing cracks to first appear near the ends of such blades. The lower mill is also subject to the substantial torque required to drive the mill, and to torsional impacts from the blades engaging (hitting) the side of the window and the cut slot. The torsional stress is sufficiently high to promote crack growth.

The disclosure herein provides a milling apparatus that addresses at least some of the above-described deficiencies of the mills.

SUMMARY OF THE DISCLOSURE

In one aspect, the present disclosure provides a mill for use in milling a section of a casing in a wellbore that in one embodiment includes a first concave curved section followed by a substantially flat section and a second concave curved section following the substantially flat section and a number of blades attached to the first concave curved section, substantially flat section and the second concave curved section, wherein each such blade includes a first convex curved section that corresponds to the first concave curved section and a second convex curved section that corresponds to the second concave curved section.

In another aspect, a method of milling a section of a casing in a wellbore is disclosed that in one embodiment includes: placing a ramp at a selected location in the casing; conveying a bottom hole assembly in the wellbore, the bottom hole assembly including a mill that contains a plurality of blades attached to a blade body, wherein at least one blade in the plurality of blades includes a tapered curved section attached to a corresponding curved tapered section along downhole side of the blade body for reducing stress on an end of the such blade; and milling a section of the casing above the ramp by the mill. In another aspect, one or more blades may further be attached to a curved tapered section on an uphole side of the blade body and wherein each such blade includes a curved section that corresponds to the curved section on the uphole side of the blade body. In another aspect a one or more bosses may be provided downhole and/or uphole of the blades to reduce the stresses on and extend the fatigue life of the blades.

Examples of certain features of the apparatus and method disclosed herein are summarized broadly in order that the detailed description thereof that follows may be better understood. There are, of course, additional features of the apparatus and method

BRIEF DESCRIPTION OF THE DRAWINGS

The disclosure herein is best understood with reference to the accompanying figures in which like numerals have generally been assigned to like elements and in which.

DESCRIPTION OF THE EMBODIMENTS

Figure 1:
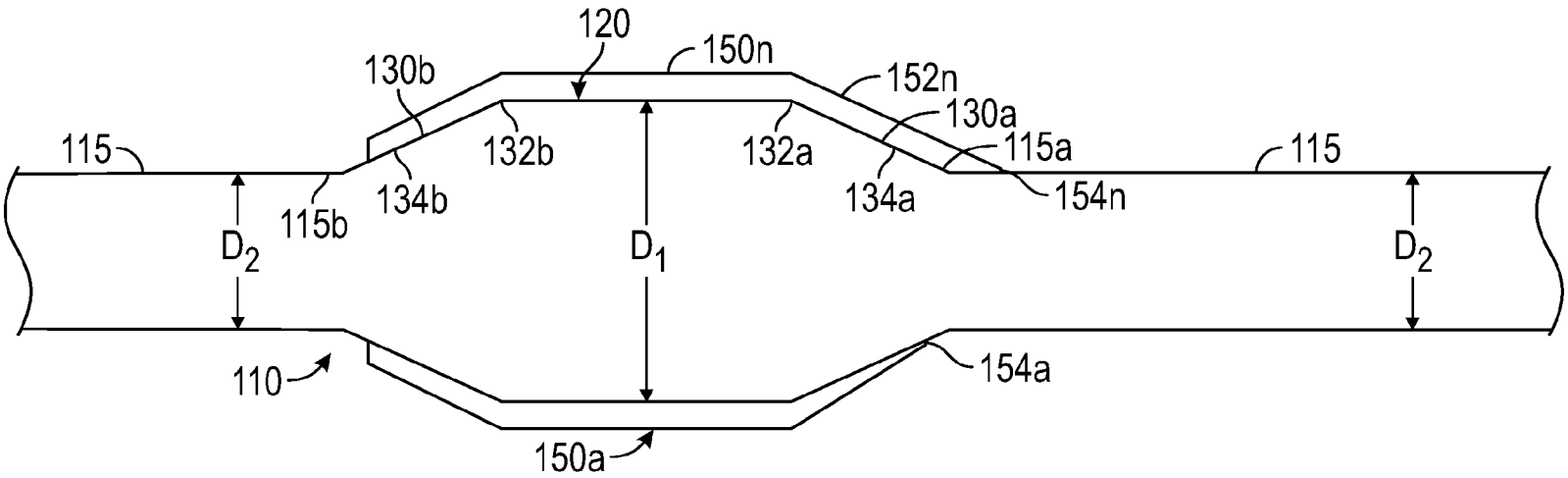
FIG. 1 (Prior Art)
FIG. 1 (Prior Art) shows a line diagram of a prior art mill having a larger diameter (raised) section that tapers on both sides to a smaller diameter pipe and a blade attached to the tapered and larger diameter sections.

FIG. 1 shows a line drawing of a partial prior art mill 100 that includes a body (also referred to as the "blade body") 110 that includes a raised section 120 having a diameter D1 and a first tapered section or lower tapered section 130*a* that transitions or extends from an end 132*a* of the raised section 120 to a point 115*a* on a pipe 115 having a diameter D2 toward a downhole side of the mill 100 (in this example, the right side). A second tapered section (or upper tapered section or ramp) 132*b* transitions or extends from the second end 132*b* of the raised section 120 to a point 115*b* on the tapered section 130*b* toward an uphole side (in this example, the left side) of the mill 100. The diameter D1 is greater than the diameter D2. The tapered sections 130*a* and 130*b* have respectively straight or flat outer surfaces 134*a* and 134*b*. A number of blades, such as blades 150*a* and 150*n* are attached circumferentially on surface 134*a*, the raised section 120 and the surface 134*b*. It is known that the ends 154*a* and 154*n* of blades 150*a* and 150*n* at the pipe 115 are subject to damage during milling of an opening in a casing. In some cases the prior art mills, such as mill 100, provide a relief radius (not shown) covered with a wear resistant material to limit wear during milling. The application of the wear resistant material, typically tungsten carbide, is a high temperature process that can reduce the strength of the steel pipe, such as pipe 115. During milling operations, the lower tapered section, such as section 130*a*, moves the mill 100 laterally into the casing, bending the blade body 110, which develops a high stress concentration at the end of the blades, such as end 154*n* of blade 154. Therefore, cracks typically first appear near the ends of the blades. The mill, such as mill 100, is also subject to the substantial torque required to drive the mill and torsional impacts from the blades hitting the side of the window and the slot cut in the casing. The cracks formed are typically formed at an angle or even turn as they propagate or grow.

Figure 2:
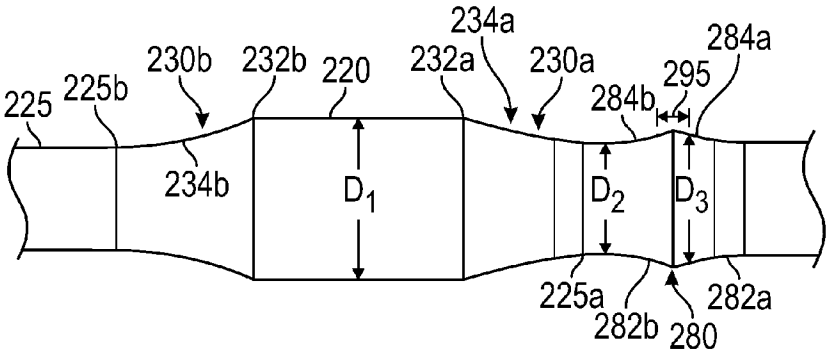
FIG. 2 shows a line diagram of a blade body that includes a raised section on a pipe with curved tapered sections on both sides of the pipe having a curved outer surface, according to one embodiment of the disclosure.

FIG. 2 shows a line diagram of a blade body 200, according to a non-limiting embodiment of the disclosure. The blade body 200 includes a raised section 220 having a diameter or an outer dimension D1 and a first or lower tapered section 230*a* that transitions or extends from a first end 232*a* of the raised section 220 to a point 225*a* on a pipe 225 having a diameter or an outer dimension D2 toward the lower or downhole side of the blade body 200 (in this example, the right side). A second or upper tapered section 230*b* transitions or extends from the second or upper end 232*b* of the raised section 220 to a point 225*b* of the pipe 225 toward an upper or uphole side (in this example, the left side) of the blade body 200. The diameter D1 is greater than the diameter D2. The tapered sections 230*a* and 230*b* include curved surfaces (also referred to herein as "radiused" surfaces") 234*a* and 234*b* respectively. The tapered section 230*a* may include more than one curved surfaces, such as surfaces with the same or different curvatures. In one aspect, the radius or curvature of surface 234*a* may be made as large as possible before it approaches a straight line in nature such that the stress reducing benefits are compromised. Up to a point as the curvature on the downhole or front side of the raised section is made larger, the stress in the blades and body near the end of the blades placed on such surface is reduced. Large radius surfaces, such as surfaces 234*a* and 234*b* provide additional length on the outer surface (compared to the flat surfaces 134*a* and 134*b*, FIG. 1) that elongate when the blade body 200 is bent, without excessive stretching and stress. A curved or radiused surface provides more surface length compared to a non-radiused surface. The relatively greater surface length prevents bending stress accumulation as the radiused surface is bent into a straight surface, compared to a non-radiused surface exposed to bending, since the area near the blade will experience stress from the cumulative stretching along the blade surface. In one aspect, a computer model is used to determine the optimum contour for minimum or optimal bending stress on the curved surface 234*a*. The computer modes or equations for determining torsional stress concentration are similar to the bending stress models and thus a low bending stress concentration will have a low torsional stress concentration as well. Such models are known in the art and are not described herein. In one aspect, the blade body 200 may further include an enlarged section or boss 280, on downhole side (in this example, the right side) of the raised section 220, having a tapered section 282*a* on the downhole or lower side and section 282*b* on the upper or uphole side. The surfaces 284*a* and 284*b* of sections 282*a* and 282*b* may be curved. The curvature or radius 284*a* of section 282*a* and curvature or radius 284*b* of section 282*b* may be same or different. The diameter D3 of boss 280 is between the diameters D1 and D2. In another aspect, the boss 280 may be a cusp or may have a flat surface. The diameter or outer dimension of the boss 280 is between the diameters D1 and D2. In another aspect, the outer most surface of the boss 280 may have a length less than half the diameter D2. In yet another aspect, another boss (not shown) may be provided uphole of the upper tapered section 230*b* to reduce bending stresses. In yet another aspect, more than one boss may be provided on one or both sides of the raised section 220. A boss on the upper side of the raised section 220 is more useful in reducing bending stress in larger mills.

Figure 3:
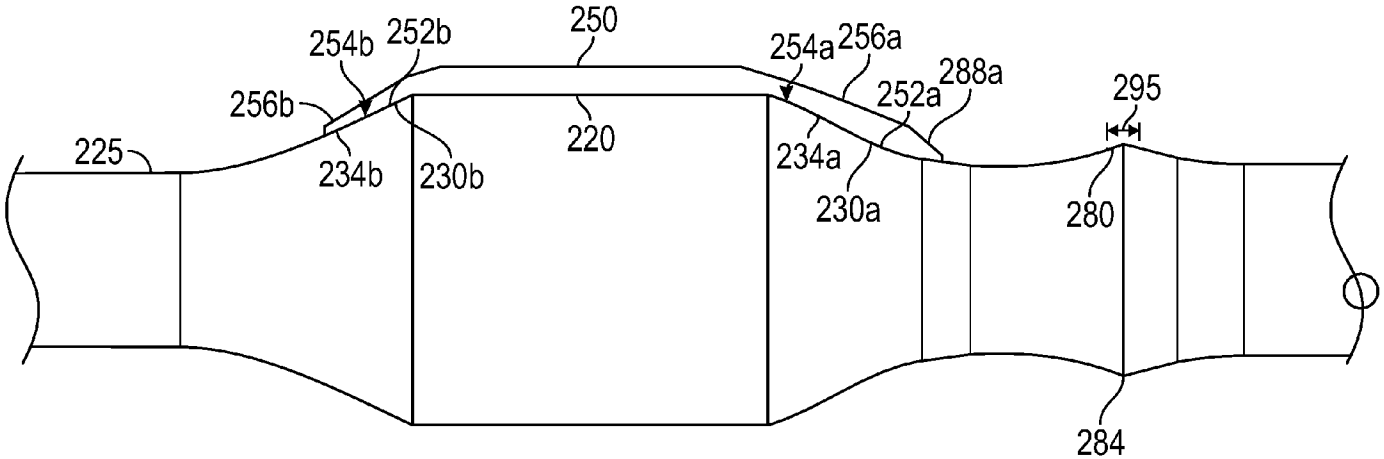
FIG. 3 shows a blade attached to the curved tapered sections and the raised section of the blade body shown in FIG. 2, wherein the underside of the blade profile matches or substantially matches the curved tapered sections.

FIG. 3 show the blade body 200 of FIG. 2 with a blade 250 attached, such as by welding, on the upper curved surface 234*b*, raised section 220 and the lower curved surface 234*a*. In one aspect, the underside 252*a* of the lower blade section 256*a* includes a curved surface 254*a* that matches or conforms or substantially matches or conforms to the contours of curved surface 234*a* of section 230*a* and the underside surface 252*b* of the upper section 256*b* of the blade 250 matches or conforms or substantially matches or conforms to the contour of the surface 234*b* of the curved section 230*b*.

Referring to FIGS. 2 and 3, as discussed above in reference to FIG. 1, the prior art mills provide a relief radius covered with a wear resisting material to prevent grooves from being worn in the pipe. The application of the wear resisting material, typically tungsten carbide, is a high temperature process which compromises the strength of the steel pipe, such as pipe 225. In one aspect, the disclosure herein addresses such a problem by providing the enlarged section or boss 280 adjacent to the radiused section 230*a*. In one aspect, such an enlargement holds the mill 200 away from the casing being milled to avoid damage to the ends of the blades, such as end 288*a* of blade 250. In another aspect, the boss 280 may have a narrow width or outside diameter surface 284. Thus, in the non-limiting configuration shown in FIG. 3, the mill includes a narrow diameter enlargement or boss 280 formed by a continuation of the neck radius 284*b* on one side, and radius 284*a* on the other side. Forming one side with the neck radius, such as radius 284*b*, near the blade ends reduces the stress on the blades during milling compared to the mills, such as mill 100 shown in FIG. 1. In one aspect, the surface width 284 of the enlarged section 280 is relatively small. In another aspect, the width 284 may be a point (cusp), as shown in FIGS. 2 and 3. In another aspect, the "point" 284 may be about 0.060". In another aspect, the upset 295 protects the front ends of the blades, which alleviates the need for applying wear resisting material, such as carbide to the radiused section of the mill. Consequently, there is less reduction in the strength of the steel in the maximum stress area, as shown in reference to FIG. 6.

Figure 4:
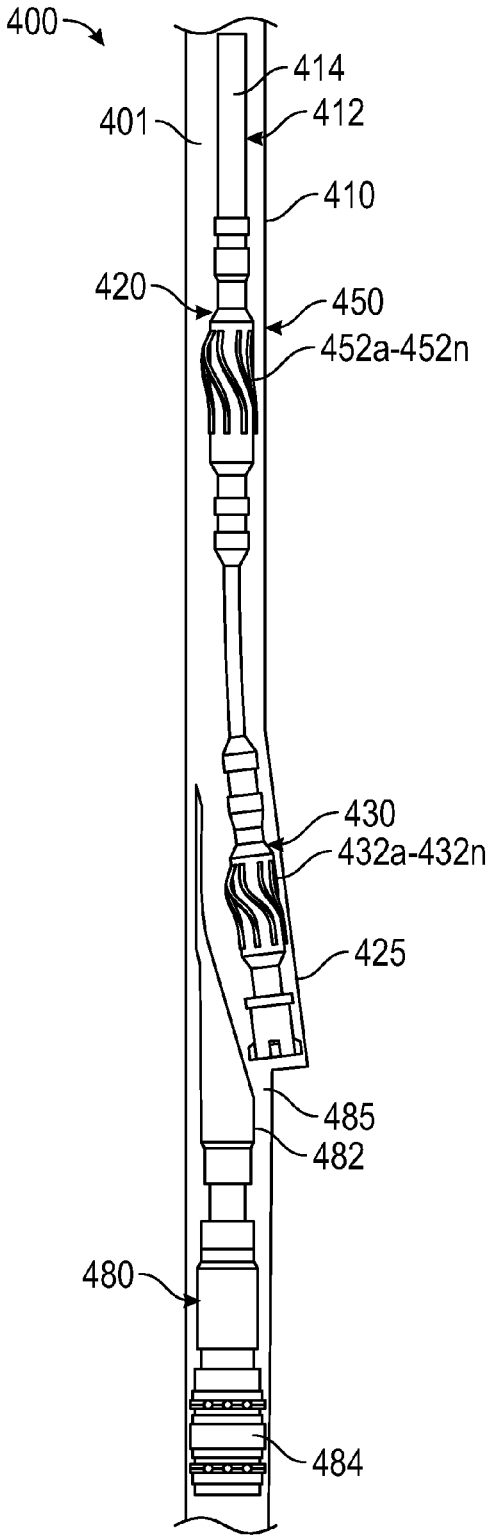
FIG. 4 shows a bottom hole assembly carrying one or more mills made according an embodiment of the disclosure.

FIG. 4 shows a wellbore system 400 with a bottom hole assembly 420 utilizing a lower mill 430 and a mill 450 made according to one or more embodiments of this disclosure for milling a casing section and forming a lateral wellbore from the milled section. The system 400 shows a wellbore 401 that is lined with a casing 410, such as a casing made from steel sections. A ramp 480 containing a whipstock 482 is shown anchored in the casing 410 by an anchor 484 at a location 485 where a window is to be milled in the casing 410. A drill string 412 containing a conveying member 414 and a bottomhole assembly 420 is shown placed inside the casing 410. The bottom hole assembly 420 includes a cutting device 425, a lower mill 430 above the cutting device 425 and a second mill 450 above the mill 430. Mill 430 or both mills 430 and 450 are made according to an embodiment of this disclosure. In the particular bottom hole assembly of FIG. 4, mills 430 and 450 are respectively shown to include blades 432*a*-432*n* and 452*a*-452*n* attached to a respective blade body, such as body 200 shown in FIG. 2. To form a window or mill a section 460 in the casing, 410, the cutting device 425 travels along the whipstock 482 and makes an initial cut in the casing 410 at location 485. The mill 430 then mills the window 460 as shown in FIG. 4. The stresses introduced in the mill 430 are reduced, compared to prior art mills, such as shown in FIG. 1 due to the boss, such as boss 280 shown in FIG. 2 and corresponding radiused tapered surfaces (such as surface 234*a*) on the blade body 200 and radiused underside surfaces on the blades (such as blade 254*a*), as described above in reference to FIGS. 2 and 3. The bottom hole assembly may be further used to form a lateral wellbore, as known in the art.

Figure 5:
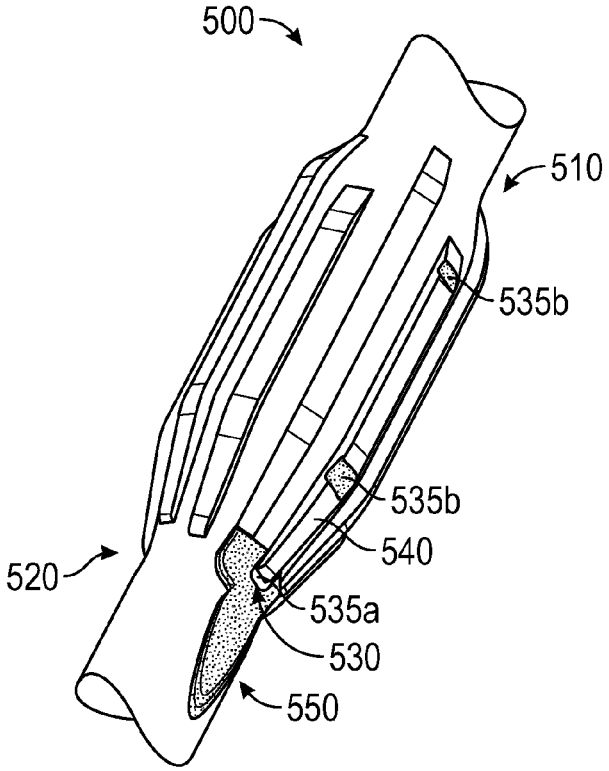
FIG. 5 shows results of an analysis showing concentration of stress in and in front of a blade on a mill made according to the prior art embodiment shown in FIG. 1.

FIG. 5 shows results of a FEA stress analysis for a prior art mill 500, similar to the mill 100 shown in FIG. 1. For this FEA analysis, the mill 500 was constrained at the back end 510 and on the gage, and the front end 520 bent to the side as dictated by the whipstock geometry. The results shows high stress 530 in front 535*a* of the blade 540 on the gage at the point of contact with the casing wall 535*c*, and at the back 535*b* of the blade, as shown in FIG. 5. In this analysis, the maximum stress was 34,000 psi just in front of the blade 540.

Figure 6:
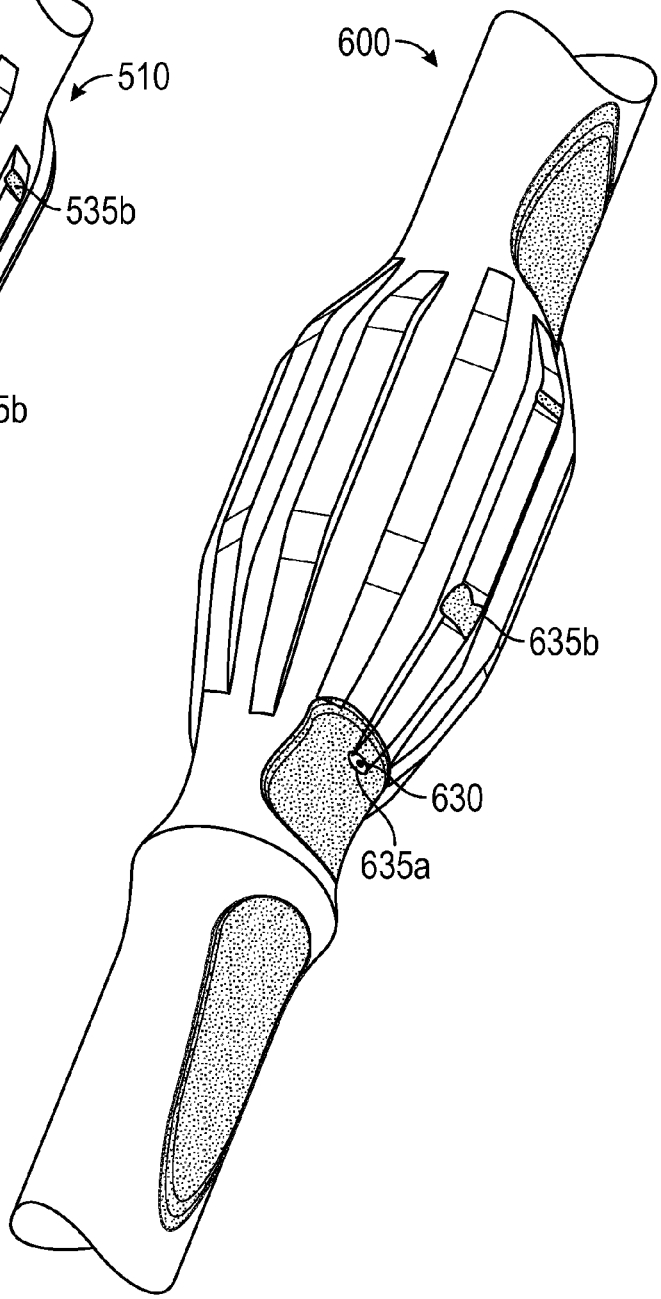
FIG. 6 shows results of an analysis showing stress concentration on a blade of a mill made according to the embodiment shown in FIG. 3.

FIG. 6 shows results of a stress analysis for a mill 600 made according to an embodiment of the present disclosure, similar to the mill 300 shown in FIG. 3. The analysis shown in FIG. 6 was performed in a manner similar to the analysis performed for mill 500 of FIG. 5. The results show a relatively lower stress 630 in front 635*a* of the blade 640 on the gage at the point of contact with the casing wall 635*b*, and at the back 635*c* of the blade 640, as shown in FIG. 6. The results show that the stress reduced from 34,000 psi to 16,000 psi in front of the blade 640. Also, the results show that the stress in mill 600 is more uniformly distributed compared to the mill 500. While the concepts of the mill are described herein in reference to a window cutting or casing exit mill design and application, a mill made as described herein or with obvious modifications, is equally applicable in various other applications, including, but not limited to, reaming tools and operations.

While the foregoing disclosure is directed to the certain exemplary embodiments of the disclosure, various modifications will be apparent to those skilled in the art. It is intended that all variations within the scope and spirit of the appended claims be embraced by the foregoing disclosure.

What is claimed is:

1. A mill for use in a wellbore, comprising:

a blade body that includes a raised section of a first diameter and a first tapered section extending from a first end of the raised section to a first reduced section of the blade body downhole of the raised section, the first reduced section having a second diameter that is less than the first diameter, wherein the first tapered section includes a curved surface extending from the first end to the first reduced section.

2. The mill of claim 1, wherein the blade body includes a second tapered section that extends from a second end of the raised section to a second reduced section of the blade body uphole of the raised section, the second reduce section having a third diameter that is less than the first diameter, wherein the second tapered section includes a curved surface.

3. The mill of claim 1 further comprising:

a blade attached to the raised section and the first tapered section, wherein a surface of the blade includes a curved surface that substantially corresponds to the curved surface of the first tapered section.

4. The mill of claim 1 further comprising a boss disposed a selected distance downhole of the first reduced section, wherein the boss has a diameter that is between the first diameter and the second diameter.

5. The mill of claim 4 further comprising a curved tapered section between the first reduced section and the boss.

6. The mill of claim 2 further comprising a blade attached to the raised section, the first tapered section and the second tapered section and wherein the blade includes a first curved surface that substantially corresponds to the curved surface of the first tapered section and a second curved surface that substantially corresponds to the curved surface of the second tapered section.

7. The mill of claim 4, wherein an outer most surface of the boss has a length less than half the second diameter.

8. The mill of claim 4, wherein the diameter of the boss is less than twenty percent greater than the second diameter.

9. The mill of claim 1 further comprising a boss disposed on the second reduced section of the blade body.

10. The mill of claim 6, wherein the curved surfaces of the first and second tapered sections are concave and the curved surfaces of the blade are convex.

11. An apparatus for use in a wellbore, comprising:

a tubular body having a first concave curved surface followed by a flat surface and a second concave curved surface following the flat surface; and a plurality of blades attached to the first curved surface, the flat surface and the second curved surface, wherein each such blade includes a first convex surface that substantially corresponds to the first concave curved surface of the body and a second convex curved surface that substantially corresponds to the second concave curved surface of the body.

12. The apparatus of claim 11 further comprising a boss spaced from a downhole end of at least one blade of the plurality of blades.

13. The apparatus of claim 12 further comprising a curved section between the boss and at least one blade of the plurality of blades.

14. The mill of claim 12 further comprising a boss spaced from an upper end of at least one blade of the plurality of blades.

15. A method of milling a casing in a wellbore, comprising:

placing a ramp in the casing at a selected location in the casing;

conveying a bottom hole assembly in the wellbore, the bottom hole assembly including a mill that contains:

a blade body including a raised section of a first diameter and a first tapered section extending from a first end of the raised section to a first reduced section of the blade body downhole of the raised section, the first reduced section having a second diameter that is less than the first diameter, wherein the first tapered section includes a concave surface extending from the first end to the first reduced section, and a plurality of blades attached to the blade body, wherein each blade in the plurality of blades includes a tapered convex portion attached to the first tapered section for reducing stress on a downhole end of each such blade; and milling a section of the casing above the ramp utilizing the mill.

16. The method of claim 15, wherein each blade in the plurality of blades is further attached to a tapered section on an uphole side of the body and wherein each blade in the plurality of blades includes a curved portion that corresponds to the curved section on the uphole side of the body.

17. The method of claim 16, wherein the body further comprises a boss on downhole side of each blade in the plurality of blades for reducing stress on the blades.

18. The method of claim 16, wherein the body includes a boss on an uphole side of each of the blades.

19. The method of claim 15, wherein the bottom hole assembly further includes a cutting device below the mill and wherein the method further comprises cutting with the cutting device a first section of the casing above the ramp followed by milling a section of the casing above the first section with the mill.

* * * * *